US007883143B2

(12) United States Patent
Reynolds

(10) Patent No.: US 7,883,143 B2
(45) Date of Patent: Feb. 8, 2011

(54) COLLAPSIBLE PORTABLE CHILD SEAT

(76) Inventor: Julia Reynolds, 27 Spring Brook Rd., Morristown, NJ (US) 07960

( * ) Notice: Subject to any disclaimer, the term of this patent is extended or adjusted under 35 U.S.C. 154(b) by 244 days.

(21) Appl. No.: 12/080,583

(22) Filed: Apr. 4, 2008

(65) Prior Publication Data

US 2009/0250978 A1 Oct. 8, 2009

(51) Int. Cl.
*A47C 4/28* (2006.01)
*A47D 1/02* (2006.01)

(52) U.S. Cl. ..... 297/45; 297/16.2

(58) Field of Classification Search ..... 297/5, 297/6, 16.1, 16.2, 42, 45
See application file for complete search history.

(56) References Cited

U.S. PATENT DOCUMENTS 595,386 A 12/1897 Hall et al.
1,341,303 A * 5/1920 Eberle ..... 297/45
2,570,446 A 10/1951 Hoffman
2,691,410 A 10/1954 Boucher
2,916,744 A 12/1959 May et al.
3,635,520 A 1/1972 Roher et al.
3,754,786 A 8/1973 Boucher et al.
3,838,883 A 10/1974 Machen
3,839,754 A 10/1974 Hooper
4,184,711 A 1/1980 Wakimoto
4,245,849 A 1/1981 Thiboutot
4,345,777 A 8/1982 Perego
4,377,011 A 3/1983 Kinberger
4,547,015 A 10/1985 Wakimoto
4,685,725 A 8/1987 Helfrich
5,054,849 A 10/1991 Hoff
5,207,478 A 5/1993 Freese et al.
5,269,587 A 12/1993 Cunningham et al.
5,340,193 A * 8/1994 Wolf ..... 297/232
5,362,130 A 11/1994 Hoffman
5,470,039 A 11/1995 Hilger
5,496,094 A 3/1996 Schwartzkopf et al.
5,503,458 A 4/1996 Petrie
5,709,428 A 1/1998 Hugghins
5,762,310 A 6/1998 Schill
6,382,715 B1 5/2002 Tang
6,637,811 B2 10/2003 Zheng
6,644,731 B2 11/2003 Tang
6,647,560 B1 * 11/2003 Hingley et al. ..... 4/484
6,687,928 B1 2/2004 Wilson
6,817,671 B1 11/2004 Zheng
6,824,208 B2 11/2004 Zheng
6,886,195 B2 5/2005 Rimbau Vidal
6,889,393 B1 * 5/2005 Rinaldo ..... 4/484
7,073,852 B1 7/2006 Zheng
7,163,228 B2 1/2007 Faber
7,281,759 B1 10/2007 Strong et al.
2003/0127885 A1 7/2003 Tang
2004/0094996 A1 5/2004 Zheng (Continued)

*Primary Examiner*—Milton Nelson, Jr.
(74) *Attorney, Agent, or Firm*—Wolff & Samson PC

(57) ABSTRACT

A collapsible chair has an inner frame with multiple inner cross members configured in an X structure, an outer frame with multiple outer cross members configured in an X structure, a surface coupled to the inner frame and the outer frame, and a seat support extending downward from the surface and configured to support a child. The multiple inner cross members configured in an X structure each have a first inner brace member pivotally connected to a second inner brace member. Similarly, the multiple outer cross members configured in an X structure each have a first outer brace member pivotally connected to a second outer brace member.

13 Claims, 6 Drawing Sheets

U.S. PATENT DOCUMENTS

2004/0232740 A1 11/2004 Enge
2005/0264088 A1 12/2005 Tadin et al.
2006/0163922 A1 7/2006 Flannery
2007/0246915 A1 10/2007 Madigan et al.

* cited by examiner

COLLAPSIBLE PORTABLE CHILD SEAT

BACKGROUND OF THE INVENTION

The present invention relates generally to collapsible chairs and more particularly to collapsible foldable seating for children. Collapsible (e.g., foldable) chairs have been used to provide seating that is moveable and easily transportable to be available on-demand. Examples include the classic "director's" chair and more recently collapsible camping chairs and the like. While these chairs provide transportable seating for adults and may be scaled to provide similar seating for children, they do not provide a secure environment for small children. Conventional collapsible chairs may provide backs and/or arms, but generally provide no system for safely holding children so they cannot easily climb or fall out of the seat.

Further, conventional collapsible chairs borrow support structures from conventional three or four legged chairs. These chairs may be unstable and unsuitable for use by small children. That is, since small children may attempt to move in unpredictable ways and otherwise extricate themselves from the confines of a chair, a conventional chair suffers from being easily tipped.

Accordingly, an improved apparatus for providing secure and moveable child seating is desired.

BRIEF SUMMARY OF THE INVENTION

The present invention generally provides a collapsible chair. The collapsible chair has an inner frame with multiple inner cross members configured in an X structure, an outer frame with multiple outer cross members configured in an X structure, a surface coupled to the inner frame and the outer frame, and a seat support extending downward from the surface and configured to support a child.

The multiple inner cross members configured in an X structure each have a first inner brace member pivotally connected to a second inner brace member. Similarly, the multiple outer cross members configured in an X structure each have a first outer brace member pivotally connected to a second outer brace member.

These and other advantages of the invention will be apparent to those of ordinary skill in the art by reference to the following detailed description and the accompanying drawings.

DETAILED DESCRIPTION

Figure 1A:
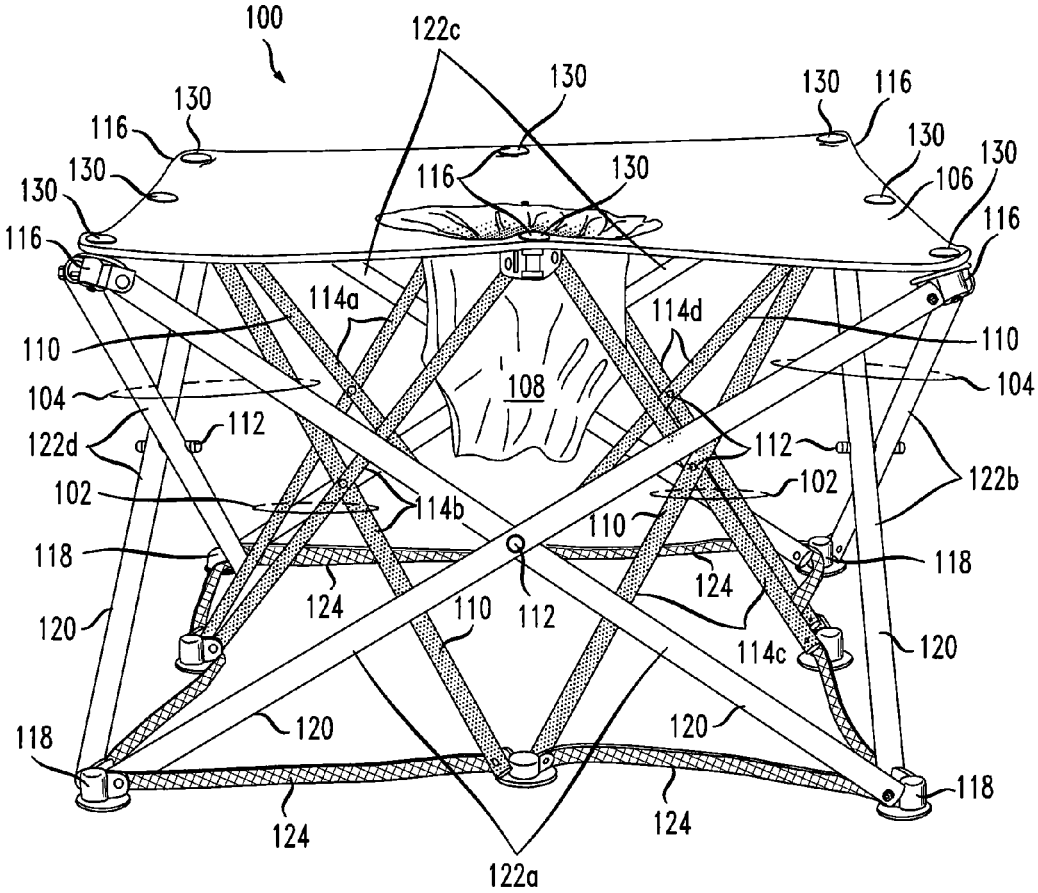
FIGS. 1A and 1B are a front perspective view of a child seat according to an embodiment of the invention.

The present invention is generally directed to a collapsible portable child seat. The child seat is collapsible to allow easy transport between locations and is highly stable to prevent tipping. As such, the collapsible portable child seat is useful for travel situations such as sporting events, camping, or the like. The seat may be carried to a desired location and opened. A small child may be placed in the collapsible portable child seat, which provides improved stability over prior collapsible chairs.

FIGS. 1A, 1B, 2, 3, and 4 depict various views of a collapsible portable child seat 100. For simplicity of exposition, identical components of seat 100 shown in multiple figures are assigned the same reference numerals and their structure and/or functions are not repeated except as necessary to further detail child seat 100.

Figure 1B:
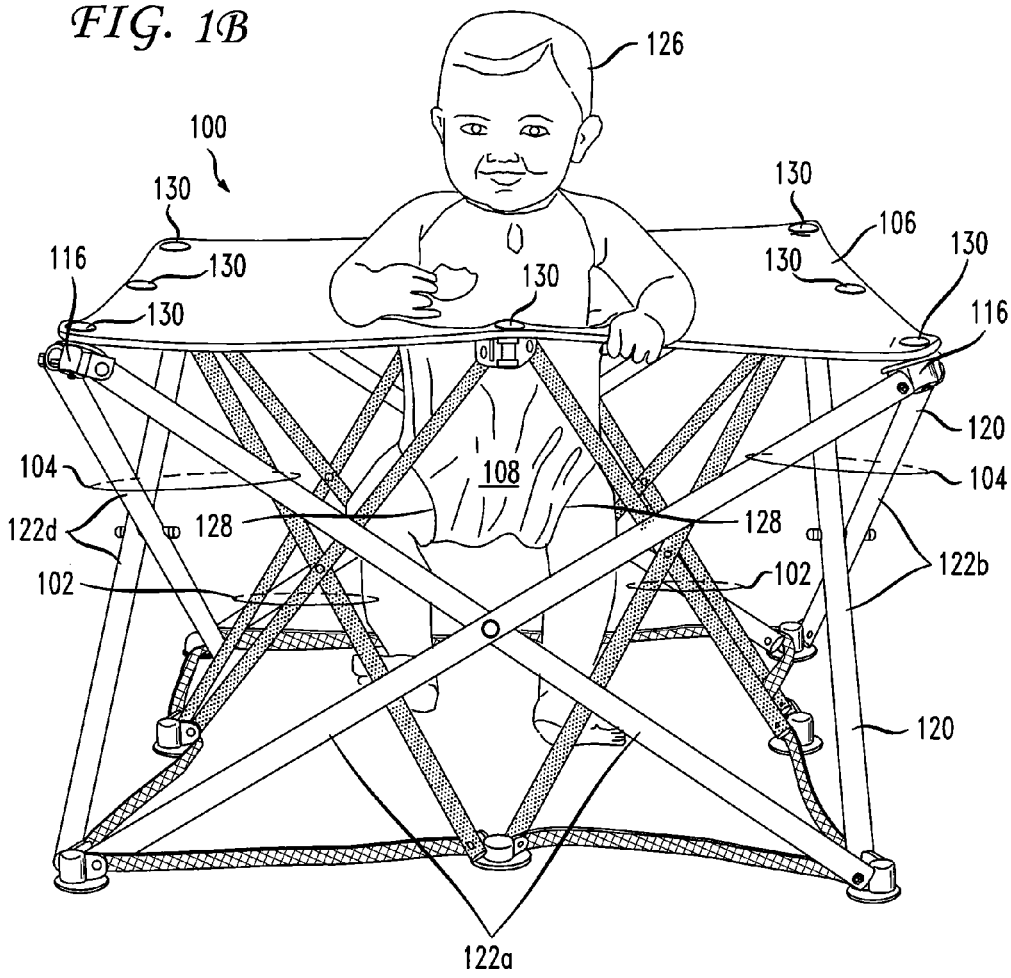
Figure 2:
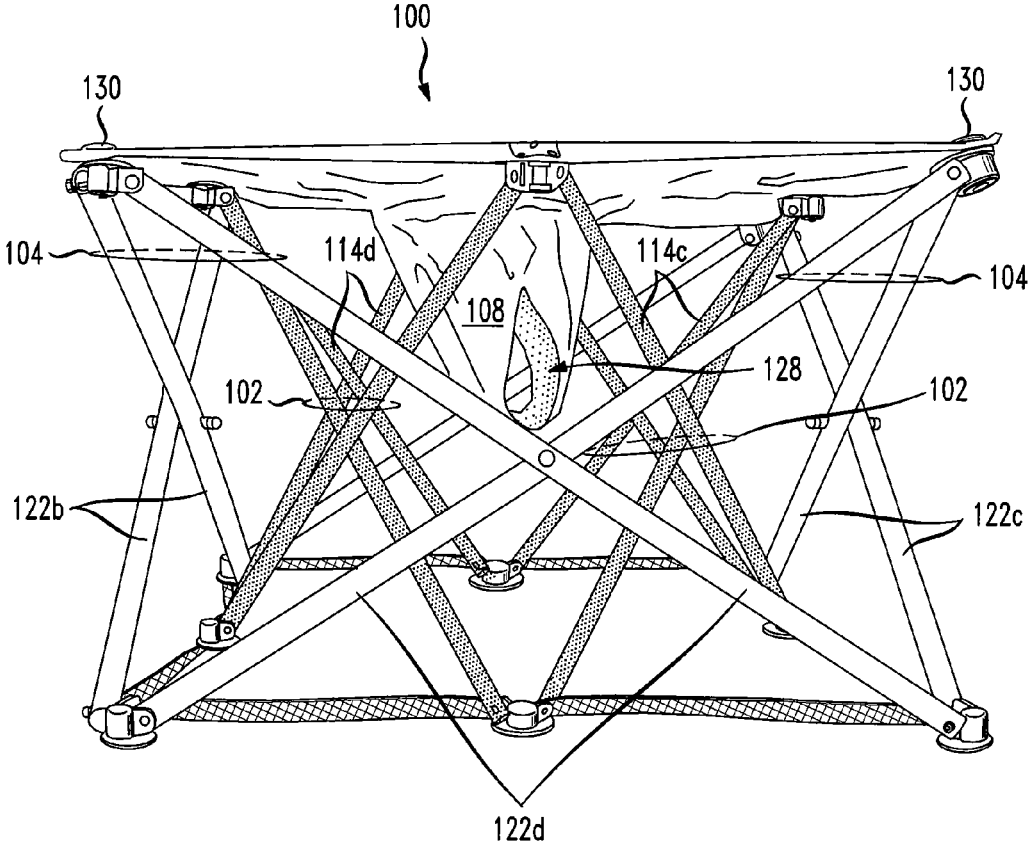
FIG. 2 is a side perspective view of a child seat according to an embodiment of the invention.

FIGS. 1A and 1B are front perspective views of seat 100. FIG. 2 is a side perspective view of seat 100. Seat 100 has an inner frame 102 and an outer frame 104, generally coupled to and supporting a surface 106. Coupled to and/or suspended from surface 106 is a support 108.

Inner frame 102 includes multiple inner braces 110 coupled at pivots 112 to form inner brace cross members 114*a*, 114*b*, 114*c*, and 114*d*. Each inner brace 110 is pivotally coupled at a point along its length by a pivot 112 to another inner brace 110 in a pair. This pivotal coupling of two inner braces 110 forms a crossed or "X" structure—the crossed structure of two inner braces 110 referred to as one inner brace cross member 114*a*, 114*b*, 114*c*, and 114*d*. Inner frame 102 comprises a number of inner brace cross members 114*a*, 114*b*, 114*c*, and 114*d* coupled at brace connectors 116 and foot connectors 118. For example, a first inner brace 110 of a first inner brace cross member 114*a* is coupled at one end (e.g., an upper end) by a brace connector 116 to one end (e.g., an upper end) of a first inner brace 110 of a second inner brace cross member 114*b* and a second inner brace 110 of the first inner brace cross member 114*a* is coupled at one end (e.g., a lower end) by a foot connector 118 to one end (e.g., a lower end) of a second inner brace 110 of the second inner brace cross member 114*b*.

In at least one embodiment, inner frame 102 has four inner brace cross members 114*a*, 114*b*, 114*c*, and 114*d* coupled at brace connectors 116 and foot connectors 118 to form a substantially square inner frame 102. That is, continuing the example above, a first inner brace 110 of a third inner brace cross member 114*c* is coupled at one end (e.g., an upper end) by a brace connector 116 to the upper end of the second inner brace 110 of the second inner brace cross member 114*b* and a second inner brace 110 of the third inner brace cross member 114*c* is coupled at one end (e.g., a lower end) by a foot connector 118 to one end (e.g., a lower end) of the first inner brace 110 of the second inner brace cross member 114*b*. A first inner brace 110 of a fourth inner brace cross member 114*d* is coupled at one end (e.g., an upper end) by a brace connector 116 to the upper end of the second inner brace 110 of the third inner brace cross member 114*c* and at the other end (e.g., the lower end) by a foot connector 118 to the lower end of the first inner brace 110 of the first inner brace cross member 114*a*. A second inner brace 110 of the fourth inner brace cross member 114*d* is coupled at one end (e.g., an upper end) by a brace connector 116 to the upper end of the second inner brace 110 of the first inner brace cross member 114*a* and at the other end (e.g., the lower end) by a foot connector 118 to the lower end of the first inner brace 110 of the third inner brace cross member 114*c*.

Figure 4:
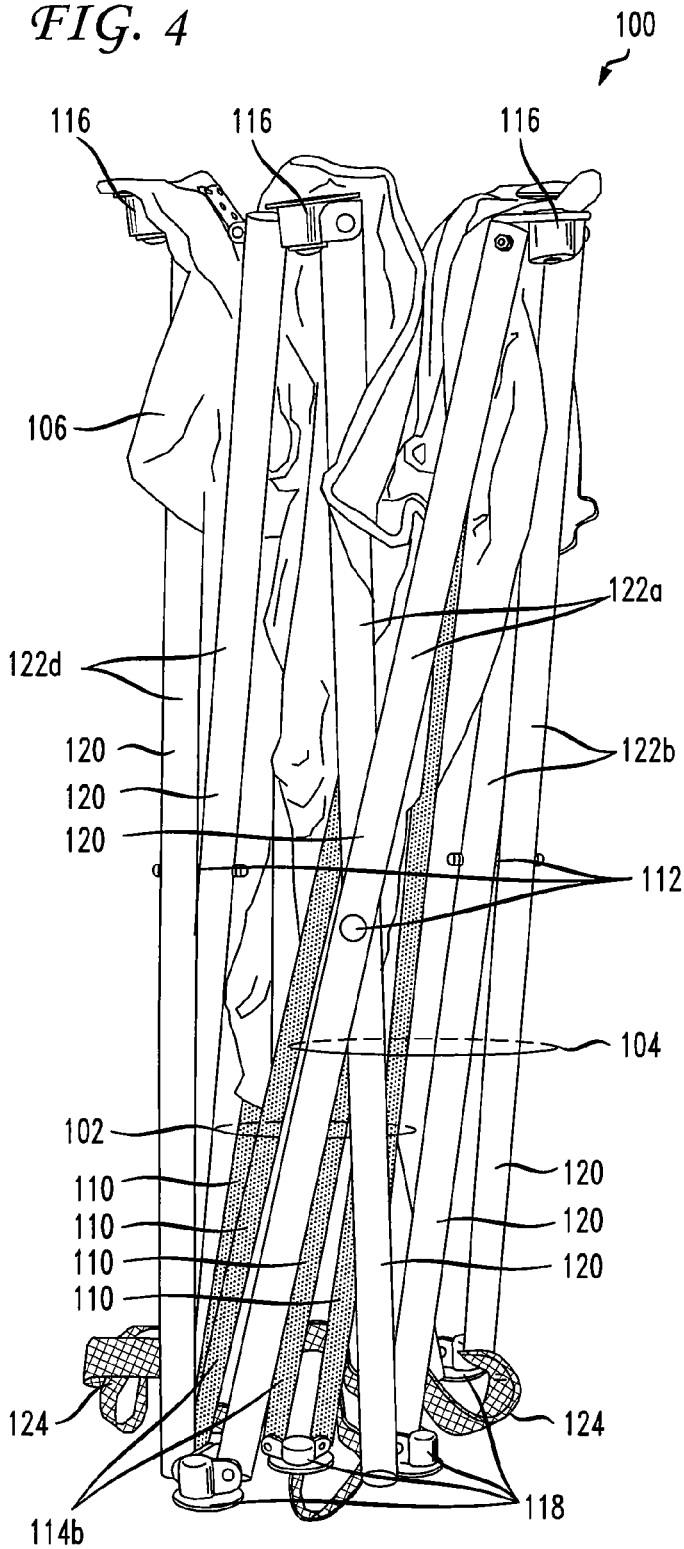
FIG. 4 is front perspective view of a child seat in a collapsed position according to an embodiment of the invention.

Each inner brace cross member 114*a*, 114*b*, 114*c*, and 114*d* is configured to fold in a scissor-like manner at pivot 112 such that when "open", each inner brace cross member 114*a*, 114*b*, 114*c*, and 114*d* forms substantially an X-type shape, as shown in FIGS. 1A and 1B. When "closed", each inner brace cross member 114*a*, 114*b*, 114*c*, and 114*d* is collapsed such that the X-type shape is as compressed as possible, as shown in FIG. 4. That is, when closed, each inner brace cross member 114*a*, 114*b*, 114*c*, and 114*d* approaches having its inner braces 110 substantially parallel. Since each inner brace cross member 114*a*, 114*b*, 114*c*, and 114*d* is pivotally connected to another inner brace cross member 114*a*, 114*b*, 114*c*, and 114*d* at brace connectors 116 and foot connectors 118, the degree of expansion in the open position and compression in the closed position is limited by the physical size (e.g., length and/or girth) of inner braces 110.

Similar to inner frame 102, outer frame 104 includes multiple outer braces 120 coupled at pivots 112 to form outer brace cross members 122*a*, 122*b*, 122*c*, and 122*d*. Each outer brace 120 is pivotally coupled at a point along its length by a pivot 112 to another outer brace 120. This pivotal coupling of two outer braces 120 forms a crossed or "X" structure—the crossed structure of two outer braces 120 referred to as one outer brace cross member 122*a*, 122*b*, 122*c*, and 122*d*. Outer frame 104 comprises a number of outer brace cross members 122*a*, 122*b*, 122*c*, and 122*d* coupled at brace connectors 116 and foot connectors 118. For example, a first outer brace 120 of a first outer brace cross member 122*a* is coupled at one end (e.g., an upper end) by a brace connector 116 to one end (e.g., an upper end) of a first outer brace 120 of a second outer brace cross member 122*b* and a second outer brace 120 of the first outer brace cross member 122*a* is coupled at one end (e.g., a lower end) by a foot connector 118 to one end (e.g., a lower end) of a second outer brace 120 of the second outer brace cross member 122*b*.

In at least one embodiment, outer frame 104 has four outer brace cross members 122*a*, 122*b*, 122*c*, and 122*d* coupled at brace connectors 116 and foot connectors 118 to form a substantially square outer frame 104. That is, continuing the example above, a first outer brace 120 of a third outer brace cross member 122*c* is coupled at one end (e.g., an upper end) by a brace connector 116 to the upper end of the second outer brace 120 of the second outer brace cross member 122*b* and a second outer brace 120 of the third outer brace cross member 122*c* is coupled at one end (e.g., a lower end) by a foot connector 118 to one end (e.g., a lower end) of the first outer brace 120 of the second outer brace cross member 122*b*. A first outer brace 120 of a fourth outer brace cross member 122*d* is coupled at one end (e.g., an upper end) by a brace connector 116 to the upper end of the second outer brace 120 of the third outer brace cross member 122*c* and at the other end (e.g., the lower end) by a foot connector 118 to the lower end of the first outer brace 120 of the first outer brace cross member 122*a*. A second outer brace 120 of the fourth outer brace cross member 122*d* is coupled at one end (e.g., an upper end) by a brace connector 116 to the upper end of the second outer brace 120 of the first outer brace cross member 122*a* and at the other end (e.g., the lower end) by a foot connector 118 to the lower end of the first outer brace 120 of the third outer brace cross member 122*c*.

Each outer brace cross member 122*a*, 122*b*, 122*c*, and 122*d* is configured to fold in a scissor-like manner at pivot 112 such that when "open", each outer brace cross member 122*a*, 122*b*, 122*c*, and 122*d* forms substantially an X-type shape, as shown in FIGS. 1A and 1B. When "closed", each outer brace cross member 122*a*, 122*b*, 122*c*, and 122*d* is collapsed such that the X-type shape is as compressed as possible, as shown in FIG. 4. That is, when closed, each outer brace cross member 122*a*, 122*b*, 122*c*, and 122*d* approaches having its outer braces 120 substantially parallel. Since each outer brace cross member 122*a*, 122*b*, 122*c*, and 122*d* is pivotally connected to another outer brace cross member 122*a*, 122*b*, 122*c*, and 122*d* at brace connectors 116 and foot connectors 118, the degree of expansion in the open position and compression in the closed position is limited by the physical size (e.g., length and/or girth) of outer braces 120.

Of course, inner frame 102 and outer frame 104 may have other configurations. In some embodiments, inner frame 102 and/or outer frame 104 may have additional members similar to inner braces 110 and/or outer braces 120. For example, inner frame 102 and/or outer frame 104 may have one or more locking members (not shown) that extend vertically between the brace connectors 116 and the foot connectors 118 located at the corners of surface 106. Such locking members may be extendable to accommodate moving between the open and closed positions and/or may be detachable from the brace connectors 116 and foot connectors 118 so that when the seat 100 is being collapsed, the locking members do not inhibit collapsing and when the seat 100 is open, they provide additional support.

In some embodiments, inner frame 102 and outer frame 104 are coupled by ties 124. In some embodiments, ties 124 are coupled between foot connectors 118. That is, a tie 124 attaches to a foot connector 118, which is coupled to two outer braces 120, and is then attached to an adjacent foot connector 118, which is coupled to two inner braces 110. In alternative embodiments, ties 124 are coupled between inner braces 110 and outer braces 120. That is, a tie 124 is attached proximal a lower end of an inner brace 110 and is then attached proximal a lower end of an outer brace 120. Of course, ties 124 may be attached in other locations as appropriate.

Ties 124 serve as ancillary anti-splaying support between inner braces 110 and outer braces 120. In this way, ties 124 are additional means for preventing inner frame 102 and/or outer frame 104 from over-extension. Over-extension of seat 100 occurs when the inner brace cross members 114*a*, 114*b*, 114*c*, and 114*d* and/or outer brace cross members 122*a*, 122*b*, 122*c*, and 122*d* pivot such that foot connectors 118 spread too far apart and/or the surface 106 falls too close to the ground. Ties 124 may be any appropriate securing means, such flexible (e.g., cloth, fabric, rope, etc.) straps. In at least one embodiment, ties 124 are constructed of a material with low elasticity and high yield strength.

Inner frame 102 and outer frame 104 are coupled to the surface 106 at brace connectors 116. That is, brace connectors 116 are coupled to (e.g., attached to, secured to, etc.) the surface 106. In at least one embodiment, brace connectors 116 are coupled to surface 106 via fasteners 130. Fasteners 130 may thus pass through or otherwise couple surface 106 to brace connectors 116 and/or inner braces 110. Fasteners 130 may be any appropriate fasteners, such as brads, caps, nails, tacks, bolts, tie-downs, etc. In some embodiments, surface 106 may have mechanisms for securing the fasteners 130, such as grommets, eyelets, etc. Further, the inner braces 110 and outer braces 120 are coupled to the brace connectors as described above.

FIG. 1B additionally shows a child 126 seated in the seat 100. The child 126 may be placed in the support 108 and may be thus suspended and secured in seat 100.

Surface 106 is a pliable surface able to fold and unfurl as seat 100 is closed and opened. Since surface 106 is coupled to inner frame 102 and outer frame 104 as described above, it is reactionary to the movements of the frames. When the seat 100 (e.g., inner frame 102 and outer frame 104) is open, the surface 106 is pulled out to be substantially flat and approximately parallel to the surface (e.g., ground, floor, etc.) on which the open seat 100 is placed. That is, surface 106 is pulled taut between the connections of the brace connectors 116. This prevents the "legs" (e.g., formed by inner frame 102 and outer frame 104) from splaying too wide and also allows the surface 106 to suspend the support 108 (e.g., to hold the basket of seat 108 in the air). This may also form a play area for the child 126. Surface 106 may be constructed of any appropriate flexible substance such as cloth, canvas, rubber, etc.

Support 108 is a seating area for the child 126. Support 108 may be any appropriate seating and/or securing means for holding the child 126. Generally, support 108 extends downward from surface 106, but may include a raised portion such as a back, arms, and/or other stabilizing features (not shown). In at least one embodiment, support 108 is constructed of a flexible substance such as cloth, canvas, rubber, etc. Support 108 may be constructed of the same or a different substance than surface 106.

Figure 3:
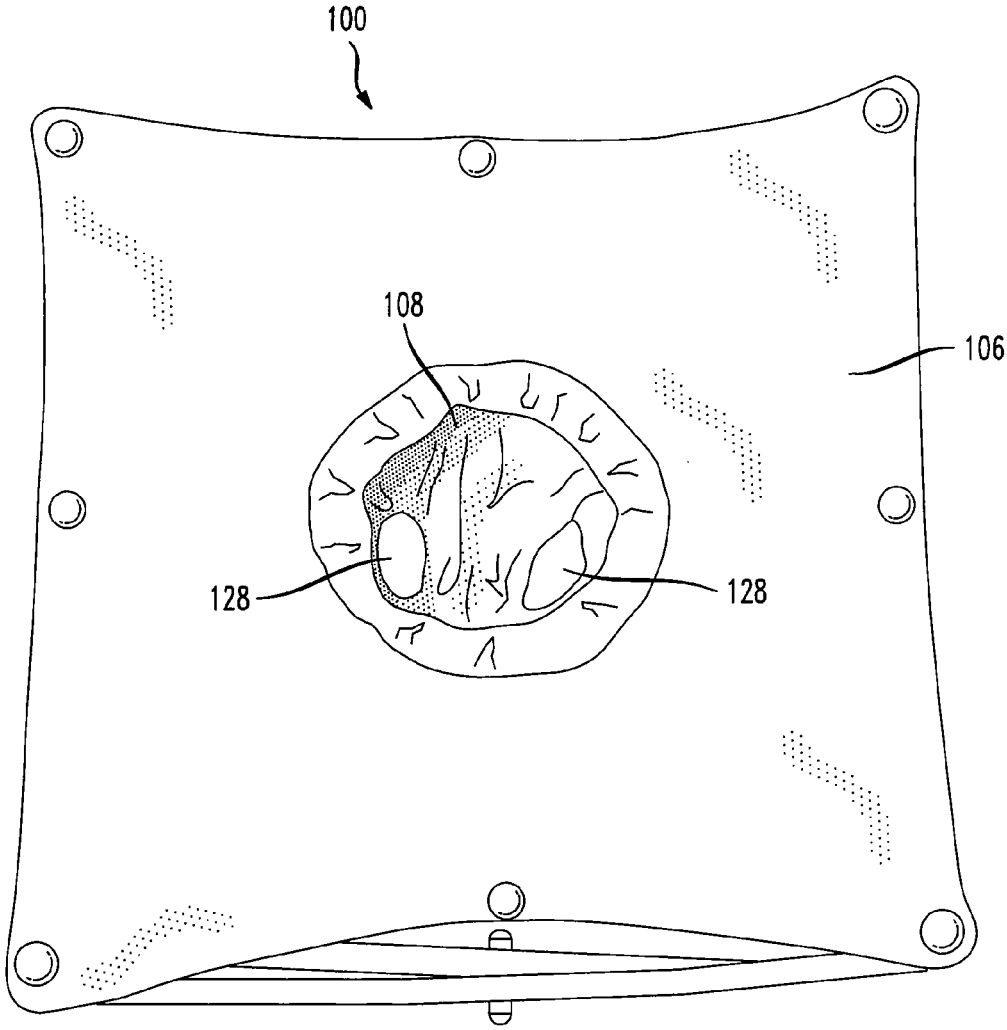
FIG. 3 is a top perspective view of a child seat according to an embodiment of the invention.

In the same or alternative embodiments, support 108 may be a sling-type (e.g., like a basket or sling) seat for child 126. FIG. 3 is a top perspective view of child seat 100 showing further details of the sling-type seat support 108 depicted in FIGS. 1A, 1B, and 2. In such a configuration, support 108 may be a bucket-like protrusion extending downward from surface 106 and have leg holes 128 through which the legs of child 126 extend. Other configurations of support 108 may be used, such as a bucket with no leg holes, a mesh support, a plank, or any other appropriate seating area. In at least one embodiment, multiple supports 108 may be used. For example two supports 108 may be positioned adjacent one another so that two children may be seated together in one seat 100.

Inner braces 110 may be any appropriate members for supporting the surface 106. In some embodiments, inner braces 110 are longitudinal and/or tubular members. In the same or alternative embodiments, inner braces 110 are constructed of plastic, PVC, aluminum, steel, or any other appropriate material. Inner braces 110 may be pivotally secured to each other by pivots 112 at a point along their length. In operation, inner braces 110 are generally pivotally secured at approximately their middle as measured along their long axes.

Similarly, outer braces 120 may be any appropriate members for supporting the surface 106. In some embodiments, outer braces 120 are longitudinal and/or tubular members. In the same or alternative embodiments, inner braces 110 are constructed of plastic, PVC, aluminum, steel, or any other appropriate material. Outer braces 120 110 may be pivotally secured to each other by pivots 112 at a point along their length. In operation, outer braces 120 are generally pivotally secured at approximately their middle as measured along their long axes.

Pivots 112 may be any appropriate pivoting or swiveling means which allow inner braces 110 and/or outer braces 120 to pivot (e.g. scissor-like) with respect to each other. Examples include bolts passed through the centers the braces and flexible (e.g., rubber, etc.) connections wrapping the braces.

In one exemplary embodiment, inner braces 110 are approximately 22 inches long and outer braces 120 are approximately 30 inches long. In this way, when inner frame 102 and outer frame 104 are open, the surface 106 is approximately 18 inches from the ground.

It should be understood that though inner braces 110 and/or outer braces 120 are said to be coupled to other inner braces 110 and/or outer braces 120, inner braces 110 and/or outer braces may actually be coupled intermediately to brace connectors 116 and/or foot connectors 118 and need not be directly attached, but merely pivotally linked. Brace connectors 116 may be any appropriate connecting means that allows inner braces 110 and/or outer braces 120 to pivot. Similarly, foot connectors 118 may be any appropriate connecting means that allows inner braces 110 and/or outer braces 120 to pivot. Conventional locking and/or non-locking connectors are known in the art and are accordingly not discussed in detail herein.

FIG. 4 depicts a front perspective view of seat 100 in a collapsed position according to an embodiment of the invention. As shown here, inner frame 102 and outer frame 104 are "closed" and the seat 100 is collapsed. Inner braces 110 are substantially parallel to their corresponding inner brace 110 in each inner brace cross member 114*a*, 114*b*, 114*c*, and 114*d*. Outer braces 120 are substantially parallel to their corresponding outer brace 120 in each outer brace cross member 122*a*, 122*b*, 122*c*, and 122*d*. The collapsed (e.g., closed) position makes the seat 100 easily transportable.

Figure 5:
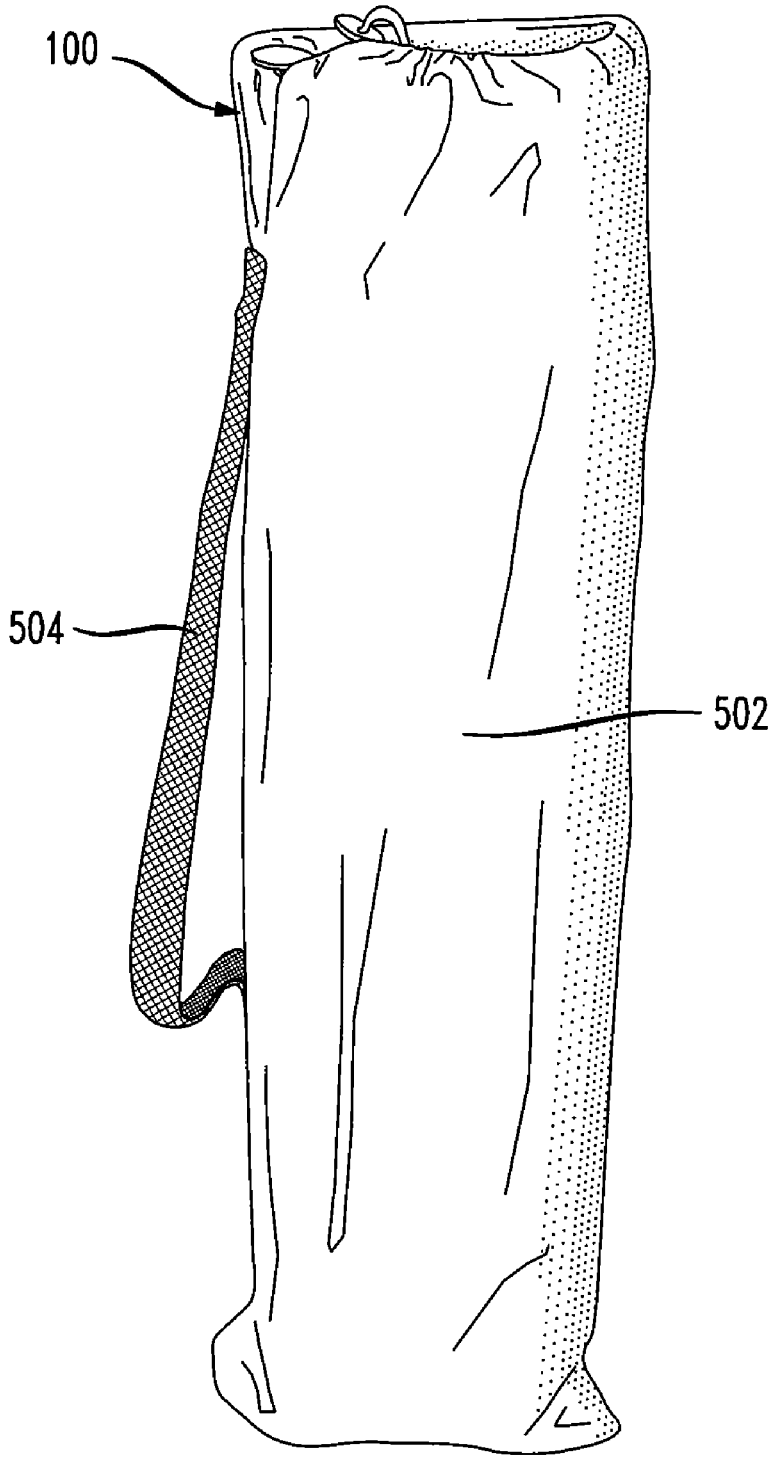
FIG. 5 is a side perspective view of a collapsed child seat in a storage bag according to an embodiment of the invention.

FIG. 5 is a side perspective view of collapsed seat 100 in a storage bag 502 according to an embodiment of the invention. Storage bag 502 holds the seat 100 in the collapsed position for storage and/or transport. To facilitate transport, storage bag 502 may have a carrying strap 504. Storage bag 502 and carrying strap 504 may be constructed of any appropriate material. In at least one embodiment, storage bag 502 and carrying strap 504 are constructed of the same material as surface 106 and/or support 108 of FIGS. 1A, 1B, 2, and 3.

In operation, seat 100 may be transported in storage bag 502. To set up seat 100, the apparatus is removed from storage bag 502 and inner frame 102 and outer frame 104 are expanded. That is, inner braces 110 and outer braces 120 form a substantial X shape as inner brace cross members 114*a*, 114*b*, 114*c*, and 114*d* and outer brace cross members 122*a*, 122*b*, 122*c*, and 122*d*. This, in turn, extends the surface 106, pulling it taut. Child 126 may be placed in the seat 110 (e.g., into the sling-like support 108).

In the open position, inner frame 102 and outer frame 104 combine to give seat 110 eight points of contact with the ground at the eight foot connectors 118. In effect, seat 110 has eight legs spaced apart an approximately equal distance from each other. This configuration provides considerable additional support and stability over a four legged chair.

A conventional four legged chair provides stability points (e.g., legs) spaced apart by 90 degrees. That is, from the center of the seat area of a chair, one leg is at 0 degrees, one leg is at 90 degrees, one leg is at 270 degrees, and one leg is at 360 degrees. As a result, the conventional chair is highly unstable to forces exerted directly between the legs (e.g., a force vector directed at 45 degrees, 135 degrees, 225 degrees, and/or 315 degrees). This may be seen by rocking a chair onto two legs or tipping it backward. For use with small children, such a chair is dangerous and easily tipped over.

Seat 110 reduces the angle between effective legs (e.g., where foot connectors 118 contact the ground) by half. Thus, seat 110 is significantly more stable. If a child 126 exerts pressure in a lateral direction (e.g., forward, backward, sideways, and/or an angle in between), the additional effective leg prevents tipping.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A collapsible chair comprising:

an inner frame comprising a plurality of inner X structures, each inner X structure comprising a pair of inner cross members;

an outer frame comprising a plurality of outer X structures, each outer X structure comprising a pair of outer cross members the inner frame disposed substantially within the outer frame;

a surface coupled to the inner frame and the outer frame; and a seat support extending downward from the surface and configured to support a child.

2. The collapsible chair of claim 1 wherein each inner X structure comprises a first inner brace member of the pair of inner cross members pivotally connected to a second inner brace member of the pair of inner cross members.

3. The collapsible chair of claim 1 wherein each outer X structure comprises a first outer brace member of the pair of outer cross members pivotally connected to a second outer brace member of the pair of outer cross members.

4. The collapsible chair of claim 1 wherein the inner frame comprises:

a first inner brace of a first pair of inner brace cross members of the plurality of inner X structures coupled at an upper end to a first brace connector and at a lower end to a first foot connector;

a second inner brace of the first pair of inner brace cross members member of the plurality of inner X structures coupled at an upper end to a second brace connector and at a lower end to a second foot connector;

a first inner brace of a second pair of inner brace cross members of the plurality of inner X structures coupled at an upper end to the first brace connector and at a lower end to a third foot connector;

a second inner brace of the second pair of inner brace cross members of the plurality of inner X structures coupled at an upper end to a third brace connector and at a lower end to the second foot connector;

a first inner brace of a third pair of inner brace cross members of the plurality of inner X structures coupled at an upper end to the third brace connector and at a lower end to a fourth foot connector;

a second inner brace of the third pair of inner brace cross members of the plurality of inner X structures coupled at an upper end to a fourth brace connector and at a lower end to the third foot connector;

a first inner brace of a fourth pair of inner brace cross members of the plurality of inner X structures coupled at an upper end to the fourth brace connector and at a lower end to the first foot connector; and a second inner brace of the fourth pair of inner brace cross members of the plurality of inner X structures coupled at an upper end to the second brace connector and at a lower end to the fourth foot connector.

5. The collapsible chair of claim 1 wherein the outer frame comprises:

a first outer brace of a first pair of outer brace cross members of the plurality of outer X structures coupled at an upper end to a first brace connector and at a lower end to a first foot connector;

a second outer brace of the first pair of outer brace cross members of the plurality of outer X structures coupled at an upper end to a second brace connector and at a lower end to a second foot connector;

a first outer brace of a second pair of outer brace cross members of the plurality of outer X structures coupled at an upper end to the first brace connector and at a lower end to a third foot connector;

a second outer brace of the second pair of outer brace cross members of the plurality of outer X structures coupled at an upper end to a third brace connector and at a lower end to the second foot connector;

a first outer brace of a third pair of outer brace cross members of the plurality of outer X structures coupled at an upper end to the third brace connector and at a lower end to a fourth foot connector;

a second outer brace of the third pair of outer brace cross members of the plurality of outer X structures coupled at an upper end to a fourth brace connector and at a lower end to the third foot connector;

a first outer brace of a fourth pair of outer brace cross members of the plurality of outer X structures coupled at an upper end to the fourth brace connector and at a lower end to the first foot connector; and a second outer brace of the fourth pair of outer brace cross members of the plurality of outer X structures coupled at an upper end to the second brace connector and at a lower end to the fourth foot connector.

6. The collapsible chair of claim 1:

wherein the inner frame comprises:

a first inner brace of a first pair of inner brace cross members of the plurality of inner X structures coupled at an upper end to a first inner brace connector and at a lower end to a first inner foot connector;

a second inner brace of the first pair of inner brace cross members of the plurality of inner X structures coupled at an upper end to a second inner brace connector and at a lower end to a second inner foot connector;

a first inner brace of a second pair of inner brace cross members of the plurality of inner X structures coupled at an upper end to the first inner brace connector and at a lower end to a third inner foot connector;

a second inner brace of the second pair of inner brace cross members of the plurality of inner X structures coupled at an upper end to a third brace foot connector and at a lower end to the second inner foot connector;

a first inner brace of a third pair of inner brace cross members of the plurality of inner X structures coupled at an upper end to the third inner brace connector and at a lower end to a fourth inner foot connector;

a second inner brace of the third pair of inner brace cross members of the plurality of inner X structures coupled at an upper end to a fourth brace foot connector and at a lower end to the third inner foot connector;

a first inner brace of a fourth pair of inner brace cross members of the plurality of inner X structures coupled at an upper end to the fourth inner brace connector and at a lower end to the first inner foot connector; and a second inner brace of the fourth pair of inner brace cross members of the plurality of inner X structures coupled at an upper end to the second inner brace connector and at a lower end to the fourth inner foot connector; and wherein the outer frame comprises:

a first outer brace of a first pair of outer brace cross members of the plurality of outer X structures coupled at an upper end to a first outer brace connector and at a lower end to a first outer foot connector;

a second outer brace of the first pair of outer brace cross members of the plurality of outer X structures coupled at an upper end to a second outer brace connector and at a lower end to a second outer foot connector;

a first outer brace of a second pair of outer brace cross members of the plurality of outer X structures coupled at an upper end to the first outer brace connector and at a lower end to a third outer foot connector;

a second outer brace of the second pair of outer brace cross members of the plurality of outer X structures coupled at an upper end to a third brace foot connector and at a lower end to the second outer foot connector;

a first outer brace of a third pair of outer brace cross members of the plurality of outer X structures coupled at an upper end to the third outer brace connector and at a lower end to a fourth outer foot connector;

a second outer brace of the third pair of outer brace cross members of the plurality of outer X structures coupled at an upper end to a fourth brace foot connector and at a lower end to the third outer foot connector;

a first outer brace of a fourth pair of outer brace cross members of the plurality of outer X structures coupled at an upper end to the fourth outer brace connector and at a lower end to the first outer foot connector; and a second outer brace of the fourth pair of outer brace cross members of the plurality of outer X structures coupled at an upper end to the second outer brace connector and at a lower end to the fourth outer foot connector; and further comprising:

a first tie coupled between the first inner foot connector and the first outer foot connector;

a second tie coupled between the first outer foot connector and the second inner foot connector;

a third tie coupled between the second inner foot connector and the second outer foot connector;

a fourth tie coupled between the second outer foot connector and the third inner foot connector;

a fifth tie coupled between the third inner foot connector and the third outer foot connector;

a sixth tie coupled between the third outer foot connector and the fourth inner foot connector;

a seventh tie coupled between the fourth inner foot connector and the fourth outer foot connector; and a second tie coupled between the fourth outer foot connector and the first inner foot connector.

7. The collapsible chair of claim 1 wherein the seat support comprises a sling-type seat with multiple leg holes.

8. The collapsible chair of claim 1 further comprising:

a plurality of ties each coupled between at least one of the plurality of inner X structures and at least one of the plurality of outer X structures.

9. A collapsible child seat comprising:

a plurality of brace cross members each comprising a plurality of braces pivotally arranged to allow the braces to move from a closed position to an open position and from the open position to the closed position, the plurality of brace cross members are arranged into an inner frame comprising four brace cross members coupled at upper ends of their respective braces by a plurality of brace connectors and at lower ends of their respective braces by a plurality of foot connectors and an outer frame comprising four brace cross members coupled at upper ends of their respective braces by a plurality of brace connectors and at lower ends of their respective braces by a plurality of foot connectors;

a flexible surface coupled to the plurality of brace members and foldable to allow the braces to move from the open position to the closed position and forming a substantially flat surface when the braces are moved to the open position; and a flexible seat support coupled to and extending downwardly from the flexible surface and configured to secure a child, wherein the inner frame is disposed substantially within the outer frame.

10. The collapsible child seat of claim 9 wherein the plurality of braces in each of the plurality of brace cross members are generally parallel to each other in the closed position and wherein the plurality of braces in each of the plurality of brace cross members are substantially an X-type shape in the open position.

11. The collapsible child seat of claim 9 further comprising:

a plurality of foot connectors each coupled to a lower end of a brace of one of the plurality of brace cross members and a lower end of a brace of another of the plurality of brace cross members; and a plurality of brace connectors each coupled to an upper end of a brace of one of the plurality of brace cross members and a lower end of a brace of another of the plurality of brace cross members, the plurality of brace connectors coupled to the flexible surface.

12. The collapsible child seat of claim 9 further comprising:

a plurality of ties each coupled between at least one plurality of braces and another of the plurality of braces.

13. The collapsible child seat of claim 9 wherein the flexible seat support is a sling-type seat with multiple leg holes.

* * * * *